US005472186A

United States Patent [19]

Paulsen

[11] Patent Number: 5,472,186

[45] Date of Patent: Dec. 5, 1995

[54] ADJUSTABLE BATTING TEE WITH AUTOMATIC BALL RETURN CAPABILITIES

[76] Inventor: Larry Paulsen, Box 20746, Sun Valley, Nev. 89433

[21] Appl. No.: 285,115

[22] Filed: Aug. 3, 1994

[51] Int. Cl.[6] ..... A63B 69/40

[52] U.S. Cl. ..... 273/26 E

[58] Field of Search ..... 273/26 R, 26 E, 273/29 A, 197 R, 197 A, 198, 184 B, 185 D, 58 C, 413

[56] References Cited

U.S. PATENT DOCUMENTS

| | | | |
|---|---|---|---|
| 1,690,158 | 11/1928 | Currie | 273/197 R |
| 3,342,482 | 9/1967 | Palone | 273/197 R |
| 4,407,503 | 10/1983 | Nishiazawa | 273/197 R |
| 5,238,251 | 8/1993 | Staka | 273/411 |

*Primary Examiner*—Theatrice Brown

[57] ABSTRACT

A vertical post having upper and lower sections and the upper section is telescopically positioned in the lower section, and has upper and lower components. The upper end of the lower component and the lower end of the upper component being engaged at an angle offset from the horizontal; a base is provided to support the vertical support. The upper and lower post sections has a plurality of complementary horizontally extending and vertically spaced apertures, a pen for extending through aligned apertures and adjusting the upper post section relative to the lower post section. A plate attached to the upper end of said support and a horizontal rod having one end attached to the plate and a ball attached to its other end. A spring member in the support for biasing the upper section towards the lower section to automatically return the ball to an initial position after being hit.

3 Claims, 4 Drawing Sheets

ADJUSTABLE BATTING TEE WITH AUTOMATIC BALL RETURN CAPABILITIES

BACKGROUND OF THE INVENTION

1. Field of the Invention

The present invention relates to an adjustable batting tee with automatic ball return capabilities and more particularly pertains to assisting young players in learning the art of hitting baseballs.

2. Description of the Prior Art

The use of batting aids of a wide variety of designs and configurations is known in the prior art. More specifically, batting aids of a wide variety of designs and configurations heretofore devised and utilized for the purpose of assisting players in developing baseball skills including hitting through various methods and apparatuses are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,830,372 a batting practice device.

U.S. Pat. No. 5,042,802 discloses a batting practice apparatus.

U.S. Pat. No. 5,048,828 discloses a batting practice device.

U.S. Pat. No. 5,072,937 discloses a baseball batting practice device.

U.S. Pat. No. 312,857 discloses the design of a tethered batting practice aid.

In this respect, the adjustable batting tee with automatic ball return capabilities according to the present invention substantially departs from the conventional concepts and designs of the prior art, and in doing so provides an apparatus primarily developed for the purpose of assisting young players in learning the art of hitting baseballs.

Therefore, it can be appreciated that there exists a continuing need for a new and improved adjustable batting tee with automatic ball return capabilities which can be used for assisting young players in learning the art of hitting baseballs. In this regard, the present invention substantially fulfills this need.

SUMMARY OF THE INVENTION

In view of the foregoing disadvantages inherent in the known types of batting aids of a wide variety of designs and configurations now present in the prior art, the present invention provides an improved adjustable batting tee with automatic ball return capabilities. As such, the general purpose of the present invention, which will be described subsequently in greater detail, is to provide a new and improved adjustable batting tee with automatic ball return capabilities and method which has all the advantages of the prior art and none of the disadvantages.

To attain this, the present invention essentially comprises a new and improved adjustable batting tee with automatic ball return capabilities comprising, in combination: a vertical support having a lower post of an enlarged diameter and an upper post of a reduced diameter, the upper post axially positionable within the lower post, the upper post having a lower component and an upper component, the upper edge of the lower component and the lower edge of the upper component having a planar surface formed therein at an angle of between about forty and fifty degrees from the horizontal; a circular base having a lower surface positionable on the ground and an upper surface adapted to receive the lower edge of the lower post and apertures at the periphery of the base for receiving stakes for securement to the ground; a plurality of aligned apertures vertically aligned in the upper post and one pair of aligned apertures in the lower post with a quick disconnect pin for coupling the upper post and lower post at any one of a plurality of locations to vary the height of the upper post with respect to the lower post and the base; an upper horizontal plate having a lower surface secured to the upper edge of the upper post and an upper surface with U bolts extending therethrough and associated nuts and a horizontal rod adjustably attached therethrough with an elastomeric ball removably attached to one end of the horizontal post for being hit by a player; an insert positioned within the upper post having a lower region secured to the lower portion and an upper region secured to the upper portion and with an adjustable spring assembly therebetween, the insert also including a lubrication fitting extending through the upper portion to allow for the lubrication between the insert and the upper portion; and stop members including a first stop plate secured to the upper portion with its elevational midpoint at the separation line between the portions and a second stop plate having its elevational midpoint at the midpoint of the separation line between the portions diametrically opposed from the first stop plate whereby striking the ball with a bat will rotate the upper component and first stop plate to allow the second component to rise on the first component until the first stop plate contacts the second stop plate whereafter the separation line between the upper and lower portions will act under gravity to return the upper component, horizontal post and ball to their original orientation.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved adjustable batting tee with automatic ball return capabilities which have all the advantages of the prior art batting aids of a wide variety of designs and configurations and none of the disadvantages.

It is another object of the present invention to provide a new and improved adjustable batting tee with automatic ball return capabilities which may be easily and efficiently manufactured and marketed.

It is further object of the present invention to provide a new and improved adjustable batting tee with automatic ball return capabilities which is of durable and reliable constructions.

An even further object of the present invention is to provide a new and improved adjustable batting tee with automatic ball return capabilities which is susceptible of a low cost of manufacture with regard to both materials and labor, and which accordingly is then susceptible of low prices of sale to the consuming public, thereby making such adjustable batting tee with automatic ball return capabilities economically available to the buying public.

Still yet another object of the present invention is to provide a new and improved adjustable batting tee with automatic ball return capabilities which provides in the apparatuses and methods of the prior art some of the advantages thereof, while simultaneously overcoming some of the disadvantages normally associated therewith.

Still another object of the present invention is to assist young players in learning the art of hitting baseballs.

Lastly, it is an object of the present invention to provide a new and improved adjustable batting tee with automatic ball return capabilities comprising: a vertical support having a lower post of an enlarged diameter and an upper post of a reduced diameter, the upper post axially positionable within the lower post, the upper post having a lower component and an upper component, the upper edge of the lower component and the lower edge of the upper component having a planar surface formed therein at an angle offset from the horizontal; a circular base having a lower surface and an upper surface adapted to receive the lower edge of the lower post; a plurality of aligned apertures vertically aligned in the upper post and one pair of aligned apertures in the lower post with a quick disconnect pin for coupling the upper post and lower post at any one of a plurality of locations to vary the height of the upper post with respect to the lower post and the base; an upper horizontal plate having a lower surface secured to the upper edge of the upper post and an upper surface with U bolts extending therethrough and associated nuts and a horizontal rod adjustably attached therethrough with an elastomeric ball removably attached to one end of the horizontal post for being hit by a player; an insert positioned within the upper post having a lower component secured to the lower portion with an upper component secured to the upper portion and adjustable spring means therebetween; and with a lubrication fitting extending through the upper portion to allow for the lubrication between the insert and the upper portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
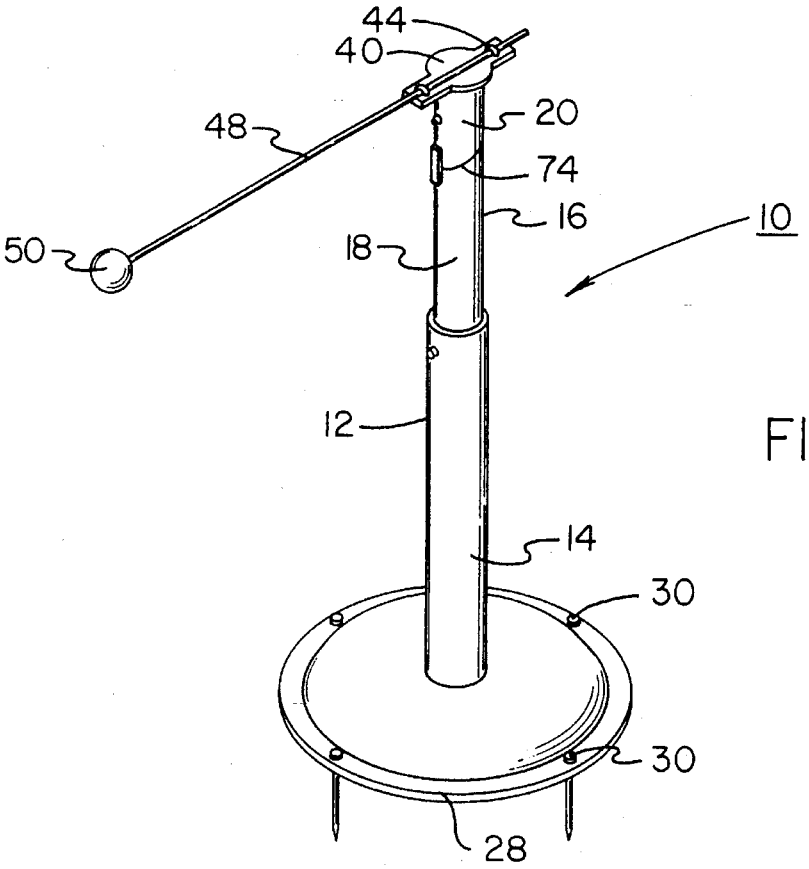
FIG. 1 is a perspective view of the preferred embodiment of the new and improved adjustable batting tee with automatic ball return capabilities constructed in accordance with the principles of the present invention.
Figure 2:
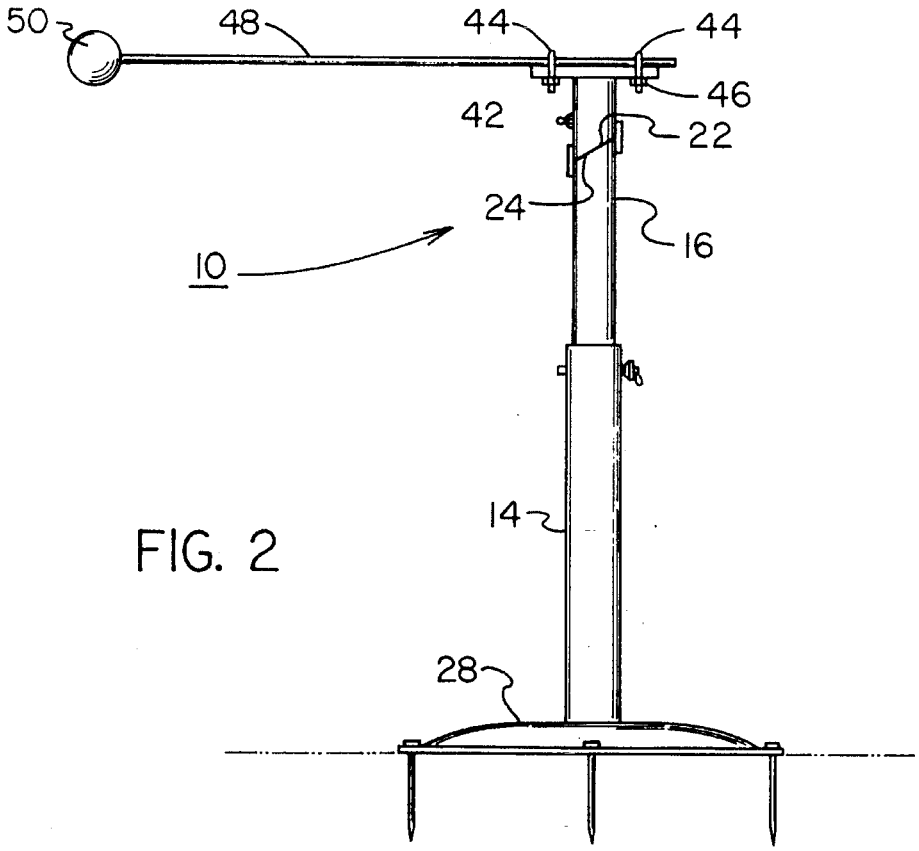
FIG. 2 is a side elevational view of the device shown in FIG. 1.
Figure 3:
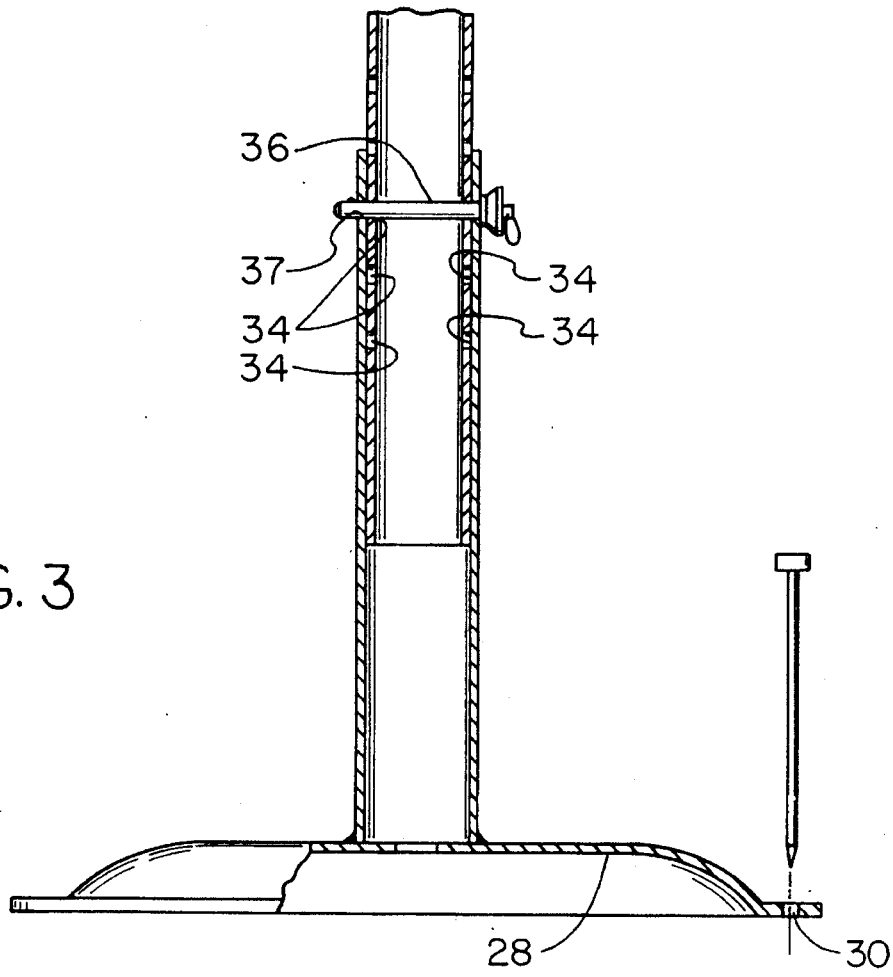
FIG. 3 is a cross-sectional view of the lower components of the device shown in the prior Figures.
Figure 4:
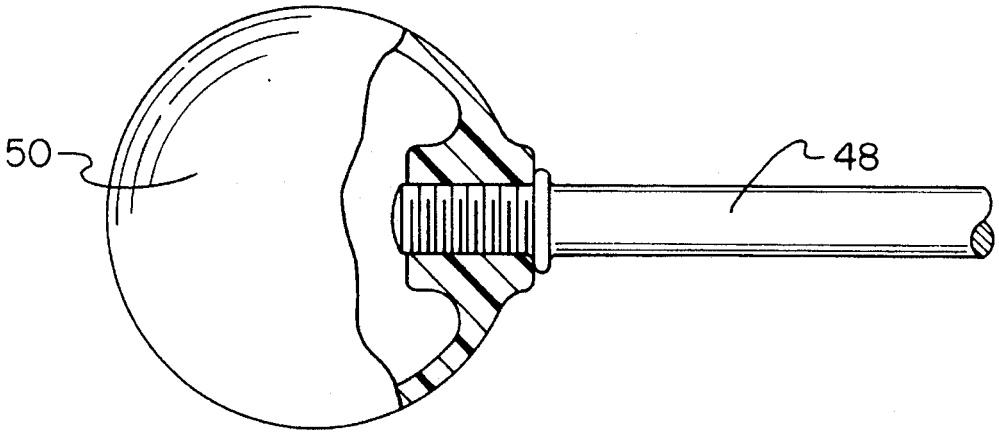
FIG. 4 is a cross-sectional view of the ball and its attachment to the device of the prior Figures.
Figure 5:
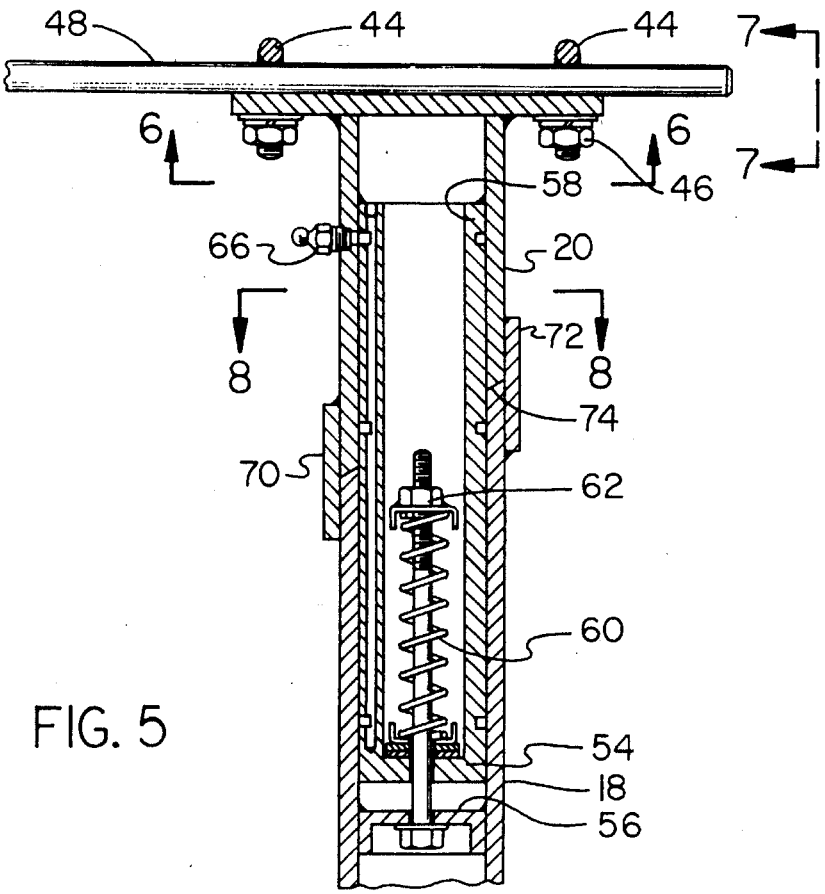
FIG. 5 is a cross-sectional of the upper extent of the apparatus shown in the prior Figures.
Figure 6:
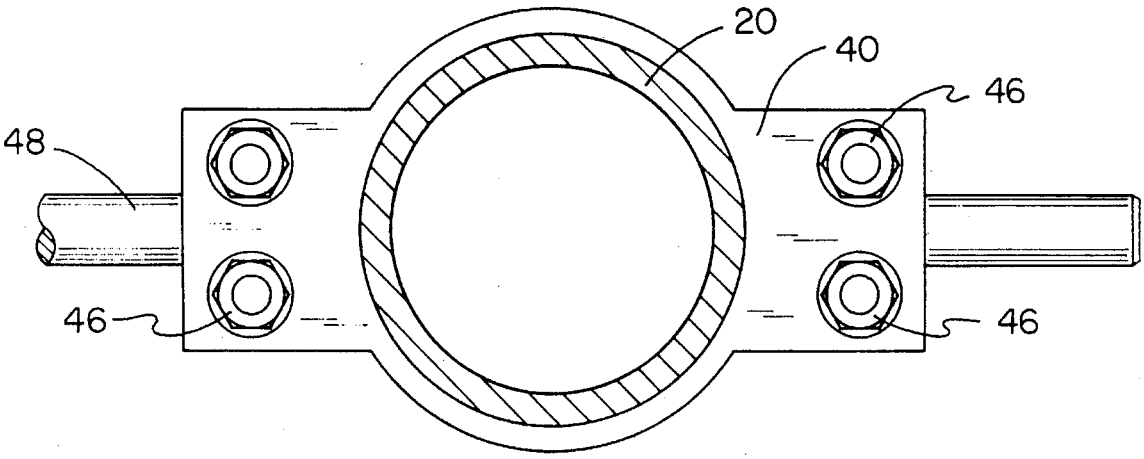
FIG. 6 is a cross-sectional view taken along line 6—6 of FIG. 5.
Figure 7:
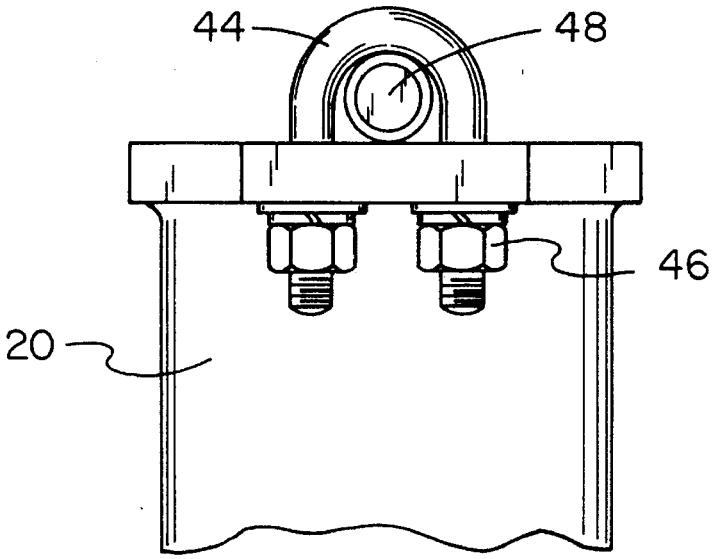
FIG. 7 is an end elevational view taken along line 7—7 of FIG. 5.
Figure 8:
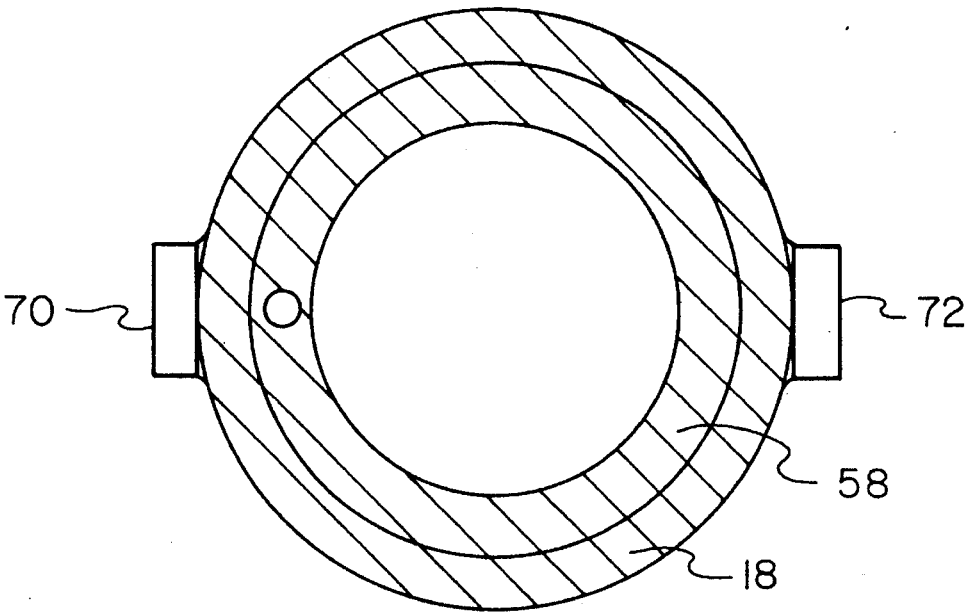
FIG. 8 is a cross-sectional view taken along line 8—8 of FIG. 5.

With reference now to the drawings, and in particular to FIG. 1 thereof, the preferred embodiment of the new and improved adjustable batting tee with automatic ball return capabilities embodying the principles and concepts of the present invention and generally designated by the reference numeral 10 will be described.

The present invention, the new and improved adjustable batting tee with automatic ball return capabilities, is comprised of a plurality of components. Such components, in their broadest context, comprise a vertical support, a circular base, apertures with a quick-release pin, an upper horizontal plate, an insert with a spring and stop members. Such components are individually configured and correlated with respect to each other so as to attain the desired objective.

The central component of the system 10 is a vertical support 12. The support has a lower post 14. The lower post has an enlarged diameter. Also included as part of the vertical support is an upper post 16. The upper post has a reduced diameter. The upper post is axially positionable within the lower post. In addition, the upper post has a lower component 18 and an upper component 20. The upper edge 22 of the lower component and the lower edge 24 of the upper component have a planar surface formed therein and effecting a separation of the components. The planar surface is at an angle of between forty and fifty degrees from the horizontal.

Next provided is a circular base 28. The circular base has a lower surface positionable on the ground or other recipient surface. The circular base also has an upper surface adapted to receive the lower edge of the lower post. In addition, apertures 30 are formed through the periphery of the base for receiving stakes to effect the securement of the base to the recipient surface such as the ground.

Next provided are a plurality of aligned apertures 34 in a vertical aligned orientation in the upper post extending upwardly from the lower edge thereof. In addition, one pair of aligned apertures extends through the lower posts. A quick-disconnect pin 36 is utilized for coupling the upper post and the lower post. The positioning may be at any of a plurality of locations and elevations to vary the height of the upper post with respect to the lower post and, consequently, the ball of the height to be hit as will be described hereinafter.

An upper horizontal plate 40 is next provided. Such upper horizontal plate has a lower surface 42 secured to the upper edge of the upper post. It also has an upper surface with U-shaped bolts 44 extending therethrough and upwardly therefrom. Associated nuts 46 are provided to couple a horizontal rod 48 which is adjustably secured thereby to the horizontal plate. An elastomeric ball 50 is removably attached to the outboard end of the horizontal post for being hit by a player to practice batting.

Adjustment of the system 10 of the present invention is effected through an insert 54. The insert is positioned within the upper post. It has a lower region 56 secured to the lower portion of the upper post. It has an upper region 58 secured to the upper portion of the upper post. An adjustment spring 60 is part of a spring assembly which also includes an adjusting nut 62. This effects the degree of friction between the upper and lower regions of the insert and the upper and lower portions of the upper post as a function of the desired strength to be overcome when hitting the ball.

The insert also includes a lubrication fitting 66. Such fitting extends through the upper portion of the upper post for the introduction of a lubrication material between the insert and the upper portion to allow smooth sliding rotational motion therebetween.

The last portion of the system 10 of the present invention are stop members which include a first stop plate 70 and a second stop plate 72. The first stop plate is secured to the upper portion of the upper post with its elevational midpoint at the separation line 74 between the portions of the upper post. The second stop plate has its elevation at the midpoint of the separation line between the portions of the upper post. The second stop plate is located around the periphery of the upper post at a location diametrically opposite from the first stop plate. In this manner, when the ball is struck by a player swinging the bat, the upper component and the first stop plate will allow the second component to rise on the first component as the ball moves. This rotation continues until the first stop contacts the second stop plate. Thereafter, the separation line between the upper and lower portions will act under gravity to return the upper component, horizontal component and ball to their original orientations for being hit again.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved adjustable batting tee with automatic ball return capabilities comprising, in combination:

a vertical support having an upper post and a lower post, the lower post having a larger diameter than the upper post, the upper post being positioned within the lower post in an operative orientation, the upper post having a lower component and an upper component, the upper and lower components each being formed in a generally cylindrical configuration, the lower component having an angled upper edge, the..upper component having an angled lower edge, the upper edge of the lower component and the lower edge of the upper component being angled at between about forty and fifty degrees with respect to the vertical support;

a circular base having a lower surface positioned on the ground and an upper surface receiving the lower edge of the lower post, the base having a periphery including apertures for receiving stakes for securement to the ground;

a plurality of aligned apertures vertically aligned in the upper post and one pair of aligned apertures in the lower post with a quick disconnect pin for coupling the upper post and lower post at any one of a plurality of locations to vary the height of the upper post with respect to the lower post and the base;

an upper horizontal plate having a lower surface secured to the upper edge of the upper post and an upper surface with U bolts extending therethrough and associated nuts and a horizontal rod adjustably attached therethrough with an elastomeric ball removably attached to one end of the horizontal post for being hit by a player;

an insert positioned within the upper post having a lower region secured to the lower portion and an upper region secured to the upper portion and with an adjustable spring assembly therebetween, the insert also including a lubrication fitting extending through the upper portion to allow for the lubrication between the insert and the upper portion; and stop members including a first stop plate secured to the upper portion with its elevational midpoint at a separation line between the portions and a second stop plate having its elevational midpoint at the midpoint of the separation line between the portions diametrically opposed from the first stop plate whereby striking the ball with a bat will rotate the upper component and first stop plate until the first stop plate contacts the second stop plate whereafter the separation line between the upper and lower portions will act under gravity to return the upper component, horizontal post and ball to their original orientation.

2. An adjustable batting tee with automatic ball return capabilities comprising:

a vertical support having an upper post and a lower post, the lower post having a larger diameter than the upper post, the upper post being positioned within the lower post in an operative orientation, the upper post having a lower component and an upper component, the upper and lower components each being formed in a generally cylindrical configuration, the lower component having an angled upper edge, the upper component having an angled lower edge, the upper edge of the lower component and the lower edge of the upper component having a planar surface formed therein at an angle offset from the horizontal;

a circular base having a lower surface and an upper surface receiving the lower edge of the lower post;

a plurality of aligned apertures vertically aligned in the upper post and one pair of aligned apertures in the lower post with a quick disconnect pin for coupling the upper post and lower post at any one of a plurality of locations to vary the height of the upper post with respect to the lower post and the base;

an upper horizontal plate having a lower surface secured to the upper edge of the upper post and an upper surface with U bolts extending therethrough and associated nuts and a horizontal rod adjustably attached therethrough with an elastomeric ball removably attached to one end of the horizontal post for being hit by a player;

an insert positioned within the upper post having a lower component secured to the lower portion and an upper component secured to the upper portion and adjustable spring means therebetween; and with a lubrication fitting extending through the upper portion to allow for the lubrication between the insert and the upper portion.

3. The apparatus as set forth in claim 2 and further including: stop members including a first stop plate secured to the upper portion with its elevational midpoint adjacent to a separation line between the portions and a second stop plate having its elevational midpoint at the midpoint adjacent to the separation line between the portions diametrically opposed from the first stop plate whereby striking the ball with a bat will rotate the upper component and first stop plate until the first stop plate contacts the second stop plate whereafter the separation line between the upper and lower portions will act under gravity to return the upper component, horizontal post and ball to their original orientation.

* * * * *